US006178556B1

(12) United States Patent
Foreman et al.

(10) Patent No.: US 6,178,556 B1
(45) Date of Patent: Jan. 30, 2001

(54) CUSTOM-FITTED CATCHER'S LEG GUARD AND METHOD

(75) Inventors: Louis J. Foreman, Huntersville; Matthew M. Winningham, Charlotte, both of NC (US)

(73) Assignee: Parker Athletic Products, LLC, Charlotte, NC (US)

( * ) Notice: Under 35 U.S.C. 154(b), the term of this patent shall be extended for 0 days.

(21) Appl. No.: 09/617,406

(22) Filed: Jul. 17, 2000

(51) Int. Cl.[7] ..... A41D 13/00; A61F 5/00
(52) U.S. Cl. ..... 2/22; 2/22; 128/882; 602/6
(58) Field of Search ..... 2/22, 16, 455, 2/911, 242; 128/846, 878, 882; 602/5–8, 23, 62

(56) References Cited

U.S. PATENT DOCUMENTS

| | | | | |
|---|---|---|---|---|
| 223,049 | * | 12/1879 | Koehler | 602/6 |
| 5,732,713 | * | 3/1998 | Duback et al. | 128/846 |
| 5,755,678 | * | 5/1998 | Parker et al. | 602/6 |
| 5,806,092 | * | 9/1998 | Shikatani | 2/22 |
| 6,042,557 | * | 3/2000 | Ferguson et al. | 602/6 |
| 6,098,208 | * | 8/2000 | Cordon | 2/455 |

* cited by examiner

*Primary Examiner*—Gloria M. Hale
*Assistant Examiner*—Tejash Patel
(74) *Attorney, Agent, or Firm*—Adams, Schwartz & Evans, P.A.

(57) ABSTRACT

A body part protector for being custom-fitted to a body part, including at least two protective pad inserts, each of the pad inserts having an initially flexible protective layer formed of a support material impregnated with a moisture-curable resin which hardens upon curing to form a rigid structure which retains a body part-defined shape into which it is molded during curing. The protective pad inserts are stored in moisture-proof conditions until use to prevent hardening. A pad encloses the at least two protective pad inserts, and is conformable to the molded shape of the pad inserts. A hard shell outer protector is adapted for receiving and carrying on an inner, concave surface thereof the pad and the at least two protective pad inserts positioned therein in protective position on the leg between the leg and the outer protector, the outer protector and the pad having complementary fastening elements for releasably securing the pad to the outer protector. Fasteners are carried by the hard shell outer protector for securing the molded and assembled body part protector to the body part to be protected.

19 Claims, 7 Drawing Sheets

CUSTOM-FITTED CATCHER'S LEG GUARD AND METHOD

TECHNICAL FIELD AND BACKGROUND OF THE INVENTION

This invention relates to a custom-fitted athletic body part protector. The guard is used for preventing injury to the player and to protect previous injuries while sports competition continues. The disclosure of this application relates specifically to a baseball knee, shin and foot protector, commonly referred to as a "shin protector" or "catcher's leg guard," such as used by catchers, although the invention relates to and has application to any body-part protector.

The invention takes advantage of polymer chemistry to permit quick and easy molding of a pad to the body part to be protected. Shock attenuation is increased since the custom fit provides spreads contact between the protective pad and the body member over a wider surface area. Instead of buying one of a few standard sizes, a protector according to the invention can be molded exactly to the shape of the body part of the user, thus obtaining a more accurate and thus more protective fit. The protector may then be held in place by straps or bands. The shin protector provides multiple layers of protection, and includes an outer shell which is attached over the custom-molded portion of the protector.

Prior art body protectors include numerous types of guards which are fitted over the body part, such as the shin. These pads typically include a soft component to place near the skin and a hard, shell-like outer cover. The soft component is intended not only to provide a cushion, but also to accommodate itself to the varying configurations of differing sized and shaped body parts with a cantilever system of protection. For this reason, the cushioned part is substantially greater in thickness than required merely to provide the required amount of shock attenuation.

Other prior art devices include pads which are constructed of thermosetting materials, which are heated and then formed to the body while heated. These products require a source of heat, and are susceptible to either over-or-underheating. In addition, body heat itself can soften or at least increase the flexibility of the pad, thereby decreasing the effectiveness of the protection offered by the pad. Some prior art pads include air bladders which provide an air cushion against injurious blows.

Other prior art devices have a plurality of connected-together segments which are hinged for limited movement relative to each other, on the theory that such movement permits the pad to more closely conform to the body part. All of these prior art devices achieve only an approximation of a truly proper and anatomically correct fit. Catcher's leg guards are typically made in a limited number of sizes, and the catcher selects the size which approximates his leg size. In some cases, the guards are shared among several players.

The present invention permits quick and easy application of a protective pad to a body part in such a way as to achieve a true custom fit. The moisture curable resin system used results in a very rigid pad, which holds the shape of the molded pad to a very high degree. No heat is required, and a source of water is the only additional substance necessary to achieve a cure.

Atmospheric moisture alone will cure the pad into its hardened position in a relatively short period of time, but the resin in or on the pad will typically be activated by dipping in water.

SUMMARY OF THE INVENTION

Therefore, it is an object of the invention to provide a multi-segment body part protector which can be molded to a body part to be protected.

It is another object of the invention to provide a multi-segment body part protector, each segment of which is independently moldable to a body part.

It is another object of the invention to provide a multi-part body part protector which hardens in the presence of moisture to form a very rigid but very lightweight protector.

It is another object of the invention to provide a multi-segment body part protector which is stored in a moisture-proof pouch until ready for application to the body part to be protected.

It is another object of the invention to provide a multi-segment body part protector which includes two or more pad segments.

It is another object of the invention to provide a catcher's leg guard which includes a custom-molded inner pad system and an outer, pre-molded protective shell to which the inner pad system is attached for use.

It is another object of the invention to provide a method of constructing a multi-segment body part protector which can be custom-fitted to a wearer.

It is another object of the invention to provide a method of custom-fitting a multi-segment body part protector to a wearer.

These and other objects of the present invention are achieved in the preferred embodiments disclosed below by providing a body part protector for being custom-fitted to a body part, and comprising at least two protective pad inserts, each of the pad inserts having an initially flexible protective layer comprised of a support material impregnated with a moisture-curable resin which hardens upon curing to form a rigid structure which retains a body part-defined shape into which it is molded during curing. The protective pad inserts are stored in moisture-proof conditions until use to prevent hardening prior to application of the pad inserts to the body part to be protected. A pad is provided for enclosing the at least two protective pad inserts, the pad being conformable to the molded shape of the pad inserts. A hard shell outer protector is provided for receiving and carrying on an inner, concave surface thereof the pad and the at least two protective pad inserts positioned therein in protective position on the leg between the leg and the outer protector. The outer protector and the pad have complementary fastening elements for releasably securing the pad to the outer protector. Fasteners are carried by the hard shell outer protector for securing the molded and assembled body part protector to the body part to be protected.

According to one preferred embodiment of the invention, the protective pad inserts each include a flexible inner cushion layer positioned on an inner side of the resin-impregnated layer for being placed closest to the body member.

According to another preferred embodiment of the invention, the support material comprises a plurality of overlaid thicknesses of fiberglass.

According to yet another preferred embodiment of the invention, the plurality of thicknesses of fiberglass comprises at least five thicknesses and no more than seven thicknesses.

According to yet another preferred embodiment of the invention, the pad comprises an envelope with compartments to hold the protective pad inserts.

According to yet another preferred embodiment of the invention, the pad means comprises a lightweight fabric.

According to yet another preferred embodiment of the invention, the complementary fastening elements comprise fastener straps carried by the pad having complementary touch fastener elements thereon and slots formed in the hard shell outer protector adjacent side edges thereof for receiving the fastener straps therethrough. Each of the fastener straps is adapted for being folded over itself and secured into a loop with a segment of the hard shell outer protector between a respective slot and adjacent side edge positioned therein.

According to yet another preferred embodiment of the invention a baseball catcher's leg guard is provided for being custom-fitted to the leg of a baseball catcher, and comprises a shin pad and a knee pad, the shin pad and the knee pad each having an initially flexible protective layer comprised of a support material impregnated with a moisture-curable resin which hardens upon curing to form a rigid structure which retains the shape of the shin and knee, respectively, onto which they are molded during curing. The shin and knee pad inserts are stored in moisture-proof conditions until use to prevent hardening prior to application of the pad inserts to shin and knee, respectively. A pad is provided for enclosing the shin pad and knee pad. The pad is conformable to the molded shape of the pad inserts. A hard shell shin protector is provided for extending along the anterior aspect of the lower leg in protective relation to the shin bone and adapted for receiving and carrying the pad and the shin pad positioned therein on an inner, concave surface thereof between the shin protector and the leg, the shin protector and the pad having complementary fastening elements for releasably securing the pad to the shin protector. A hard shell knee protector is attached to and positioned in vertical alignment with the shin protector in overlying protective relation to the knee and adapted for receiving and carrying the pad and the knee pad positioned therein on an inner, concave surface thereof between the knee protector and the leg. The knee protector and the pad have complementary fastening elements for releasably securing the pad to the knee protector. Fasteners are carried by the hard shell shin protector and hard shell knee protector for securing the molded and assembled shin guard to the leg.

According to yet another preferred embodiment of the invention, at least one foot protector is flexibly attached to a lower end of the hard shell shin protector for overlying and protecting the foot.

According to yet another preferred embodiment of the invention, first and second foot protectors are flexibly attached end-to-end along a longitudinal axis of the shin guard to a lower end of the hard shell shin protector for overlying and protecting the foot.

According to yet another preferred embodiment of the invention, the knee pad is comprised of first and second knee pad segments, the first segment positioned to overlie and protect the lower knee and uppermost portion of the tibia and the second segment positioned to overlie and protect the patella of the knee and the lowermost portion of the femur.

An embodiment of the method of constructing a body part protector assembly according to the invention comprises the steps of providing at least two protective pad inserts, each of the pad inserts having an initially flexible protective layer comprised of a support material impregnated with a moisture-curable resin which hardens upon curing to form a rigid structure which retains a body part-defined shape into which it is molded during curing. The protective pad inserts are stored in moisture-proof conditions until use to prevent hardening prior to application of the pad inserts to the body part to be protected. A pad encloses the at least two protective pad inserts, the pad being conformable to the molded shape of the pad inserts. A hard shell outer protector is provided and is adapted for receiving and carrying on an inner, concave surface thereof the pad and the at least two protective pad inserts positioned therein in protective position on the leg between the leg and the outer protector. The outer protector and the pad have complementary fastening elements for releasably securing the pad to the outer protector. Fasteners are carried by the hard shell outer protector for securing the molded and assembled body part protector to the body part to be protected. The protective pad inserts are removed from the moisture-proof condition and exposed to moisture. The protective pad inserts are molded to the body part to be protected. The position of the protective pad inserts is maintained until the protective pad inserts have hardened. The pad with the protective pad inserts therein is fastened to the hard shell outer protector to form the completed body part protector assembly.

According to one preferred embodiment of the invention, the protective pad inserts are inserted into the pad before the pad inserts are molded onto the body part.

According to another preferred embodiment of the invention, wherein the protective pad inserts are inserted after the pads have been molded onto the body part and hardened.

According to another preferred embodiment of the invention, the body part protector assembly comprises a baseball catcher's leg guard.

According to yet another preferred embodiment of the invention, a baseball catcher's leg guard is provided for being custom-fitted to the leg of a baseball catcher, and comprising a shin pad and a knee pad, the shin pad and the knee pad each having an initially flexible protective layer comprised of a support material impregnated with a moisture-curable resin which hardens upon curing to form a rigid structure which retains the shape of the shin and knee, respectively, onto which they are molded during curing. The shin and knee pad inserts are stored in moisture-proof conditions until use to prevent hardening prior to application of the pad inserts to shin and knee, respectively. A hard shell shin protector extends along the anterior aspect of the lower leg in protective relation to the shin bone and is adapted for receiving and carrying the shin pad on an inner, concave surface thereof between the shin protector and the leg. The shin protector has complementary fastening elements for releasably securing the shin pad to the shin protector. A hard shell knee protector is attached to and positioned in vertical alignment with the shin protector in overlying protective relation to the knee and is adapted for receiving and carrying the knee pad positioned therein on an inner, concave surface thereof between the knee protector and the leg. The knee protector and the knee pad have complementary fastening elements for releasably securing the knee pad to the knee protector. Fasteners are carried by the hard shell shin protector and hard shell knee protector for securing the molded and assembled shin guard to the leg.

According to one preferred embodiment of the invention, at least one foot protector is flexibly attached to a lower end of the hard shell shin protector for overlying and protecting the foot.

According to yet another preferred embodiment of the invention, first and second foot protectors are flexibly attached end-to-end along a longitudinal axis of the shin guard to a lower end of the hard shell shin protector for overlying and protecting the foot.

According to yet another preferred embodiment of the invention, the knee pad is comprised of first and second knee pad segments, the first segment positioned to overlie and protect the lower knee and uppermost portion of the tibia bone and the second segment positioned to overlie and protect the patella of the knee and the lowermost portion of the femur.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
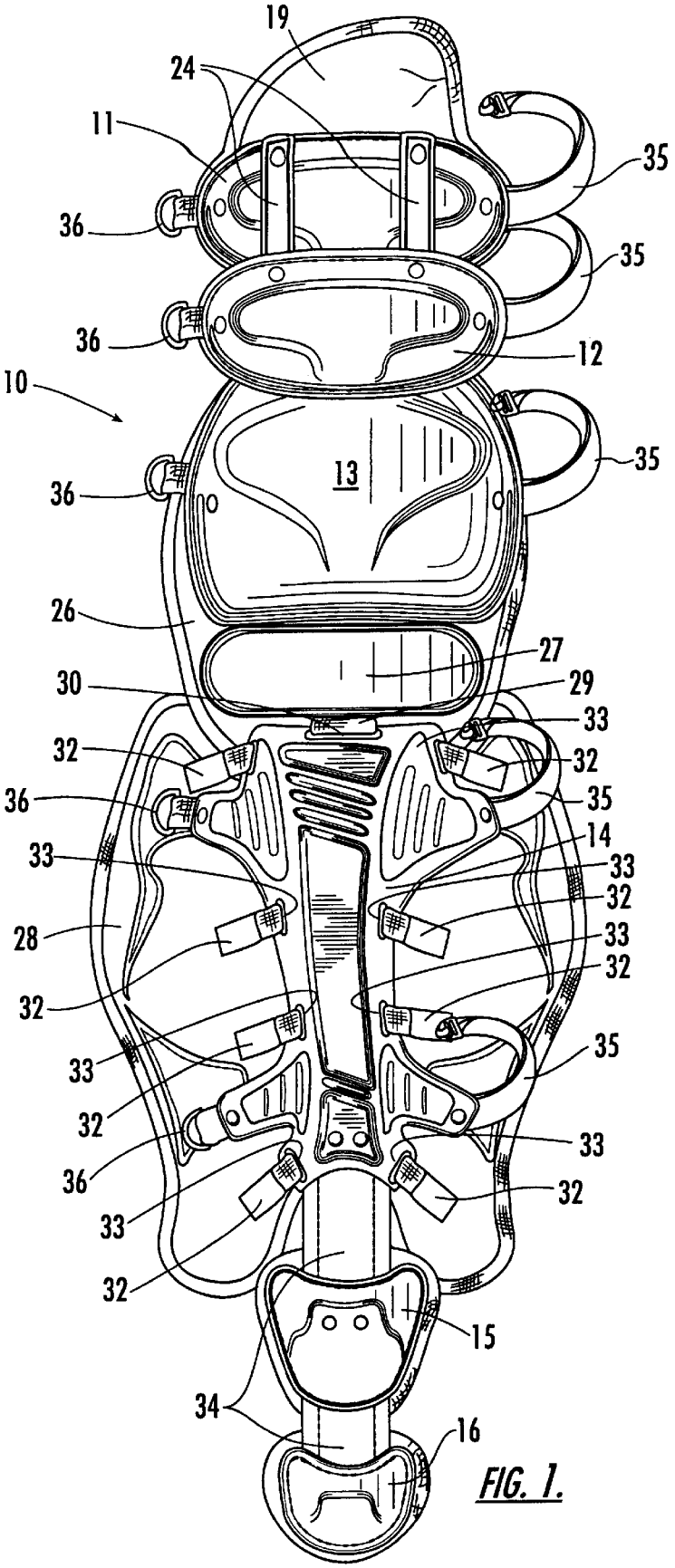
FIG. 1 is a front elevation view of a catcher's leg guard according to an embodiment of the invention.
Figure 2:
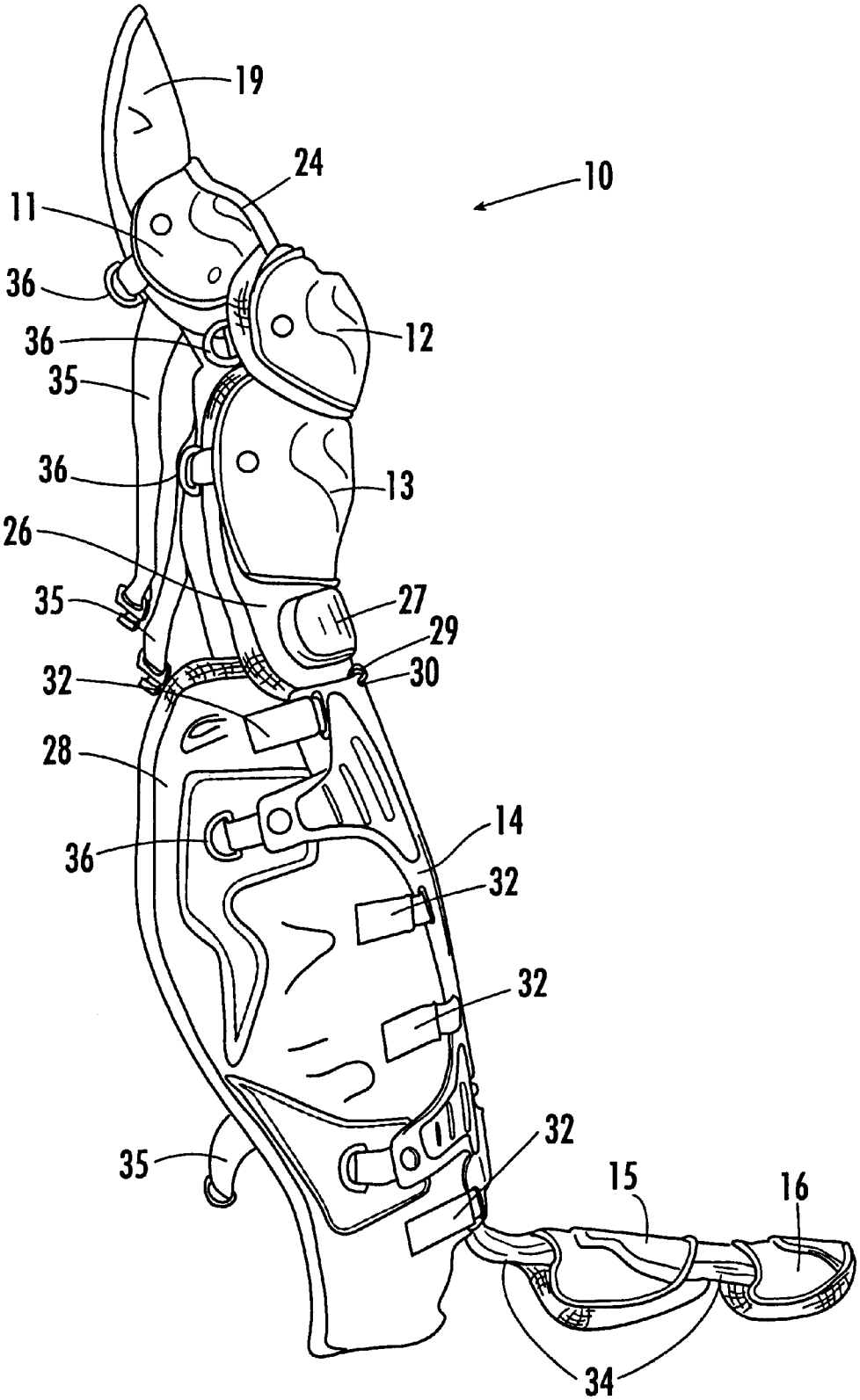
FIG. 2 is a side elevation view of one side of the catcher's leg guard shown in FIG. 1.
Figure 3:
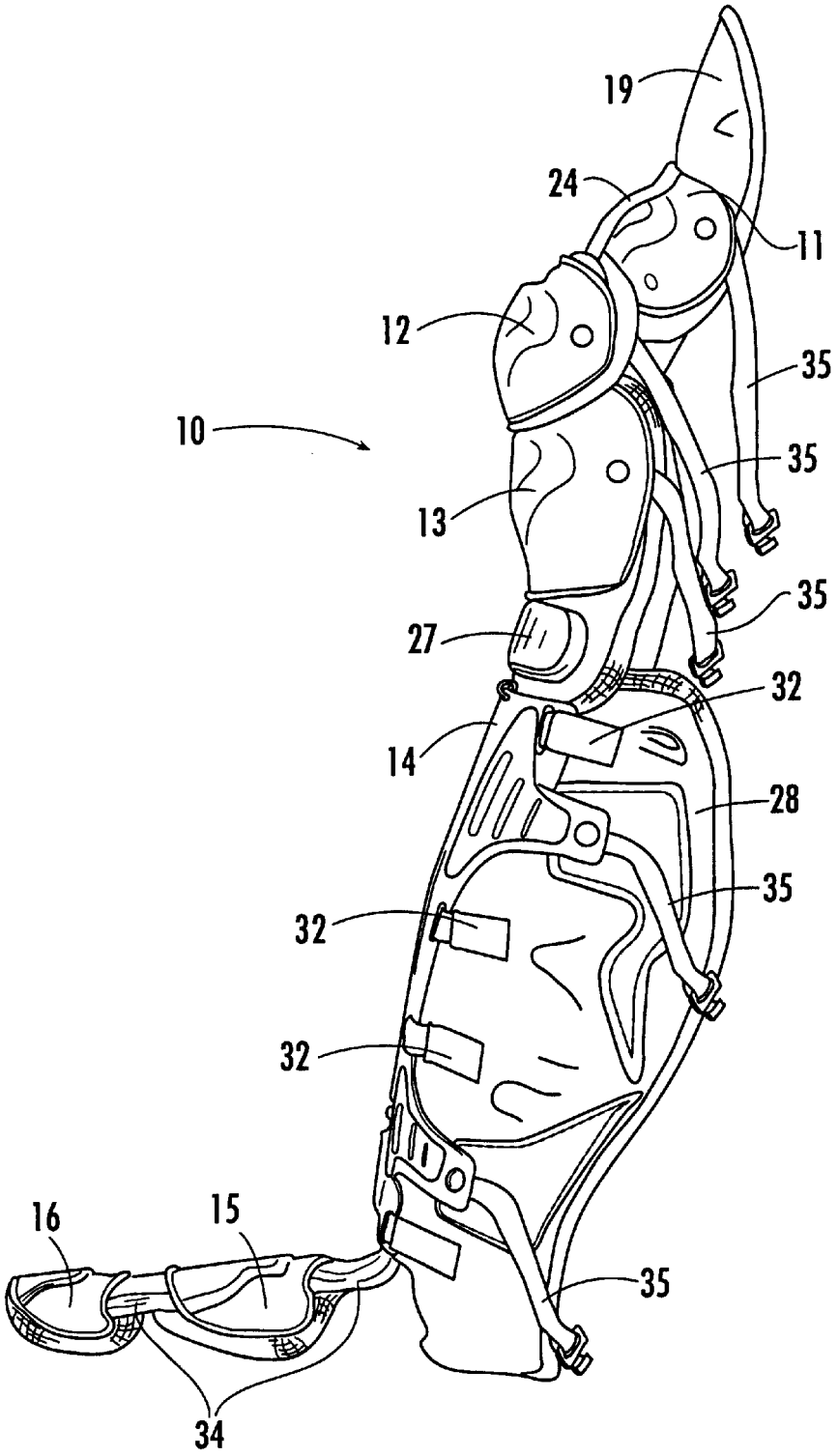
FIG. 3 is a side elevation view of the other side of the catcher's leg guard shown in FIG. 1.

Referring now specifically to the drawings, FIGS. 1–4 illustrate a body part protector according to an embodiment of the invention is shown. The body part protector as shown in the drawings is a catcher's leg guard 10 particularly intended for use by a baseball or softball catcher. As described, below, the catcher's leg guard is assembled from an number of components which collectively provide significant protection to the knee, lower leg and foot of the player, while permitting a high degree of flexibility necessary to the player to manoeuver.

The catcher's leg guard 10 is assembled from outer hard shell components which cover custom-molded and padded components. Specifically, the hard shell components include two upper knee protectors 11 and 12, a principal knee protector 13, an elongate shin guard 14, an upper foot protector 15 and a lower foot protector 16. These elements are molded of polyethylene or another hard, impact-resistant, light-weight plastic with a padded backing.

The upper knee protector 11 is riveted onto a vinyl-covered pad 19 and is attached to the principal knee protector 13 by a pair of straps 22 (FIG. 4) and rivets (not shown). The upper knee protector 12 overlies the junction between the upper knee protector 11 and the principal knee protector 13 and is flexibly-attached to the upper knee protector 11 by a pair of riveted straps 24.

The principal knee protector 13 is riveted onto a vinyl-covered pad 26 which includes a soft padded segment 27 positioned between the principal knee protector 13 and the elongate shin guard 14. The pad 26 with the principal knee protector 13 thereon is flexibly-attached to a shin pad 28 which extends from the knee to the ankle. Attachment is by a hook-and-loop strap 29 attached to the shin pad 28 and extending through slot 30 in the hard shell shin guard 14 and doubled over itself so that the complementary hooks and loops interlock. The hard shell shin guard 14 is attached to the shin pad 28 by hook-and-loop straps 32 attached to the shin pad 28 and extending through slots 33 in the hard shell shin guard 14 and doubled over themselves so that the complementary hooks and loops interlock. In addition, the inner side of the hard shell shin guard 14 includes longitudinally-extending strip of hook or loop material 29 which interconnects with a complementary strip of hook or loop material (not shown) on the outer face of the underlying shin pad 28.

The upper and lower foot protectors 15 and 16 are each riveted to a strap 34 which is riveted to the bottom of the shin pad 28 and hard shell shin guard 14. Both the upper and lower foot protectors 15 and 16 are padded on the back side with, for example, EVA foam.

As is shown by reference to FIGS. 1–4, the individual elements of catcher's leg guard 10 extend from above the knee to above the toes of the foot, thereby providing comprehensive protection to these areas. The catcher's shin guard 10 is held in place on the leg and foot by a series of elastic hook straps 35 which are attached to one side of the catcher's shin guard 10 by rivets and hook into D-rings 36. The straps 35 are themselves adjustable in length by adjustment rings 38 (see FIG. 4)) through which the straps are doubled.

Figure 4:
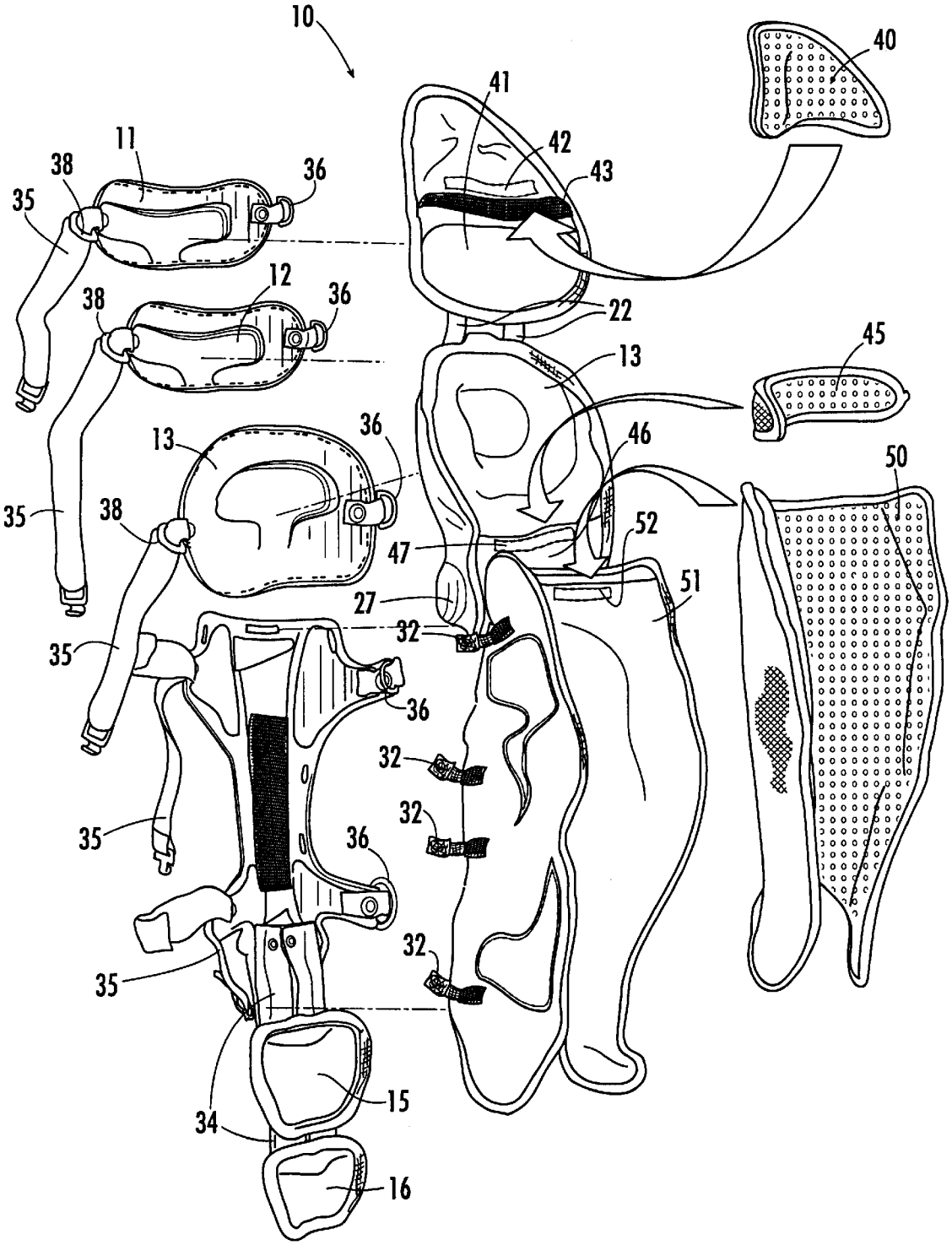
FIG. 4 is an exploded perspective view of the obverse, inwardly-facing side of the baseball leg guard shown in FIG. 1.

The catcher's leg guard 10 is custom-formed to the leg of a particular player by means of three custom-formable protective pad inserts 40, 45 and 50, each of which are constructed identically but differently sized to fit within individual pockets. As is best shown in FIG. 4, the back side of the upper knee protector pad 19 includes a fabric pocket 41 for holding the pad insert 40. The pocket 41 is releaseably closable by complementary hook-and-loop fastener strips 42, 43.

The principal knee protector pad 26 includes a narrow, laterally-extending fabric pocket 46 for holding pad insert 45. The pocket 46 is releaseably closable by a hook-and-loop fastener strip 47 which mates with a complementary strip on the interior of the pocket, not shown.

The shin pad 28 includes a large fabric pocket 51 for holding pad insert 50. The pocket 51 is releaseably closable by a hook-and-loop fastener strip 52 which mates with a complementary strip on the interior of the pocket 51, not shown.

Each of the fabric pockets 41, 46 and 51 include additional lightweight foam padding which further protects the leg.

In general, each of the pad inserts 40, 45, 50 includes a support material in the form of a substrate coated or impregnated with a moisture-curable resin which is flexible in the absence of moisture, but which rapidly hardens when exposed to moisture. The structure of these pad inserts 40, 45 and 50 is described below with specific reference to pad insert 50.

Figure 5:
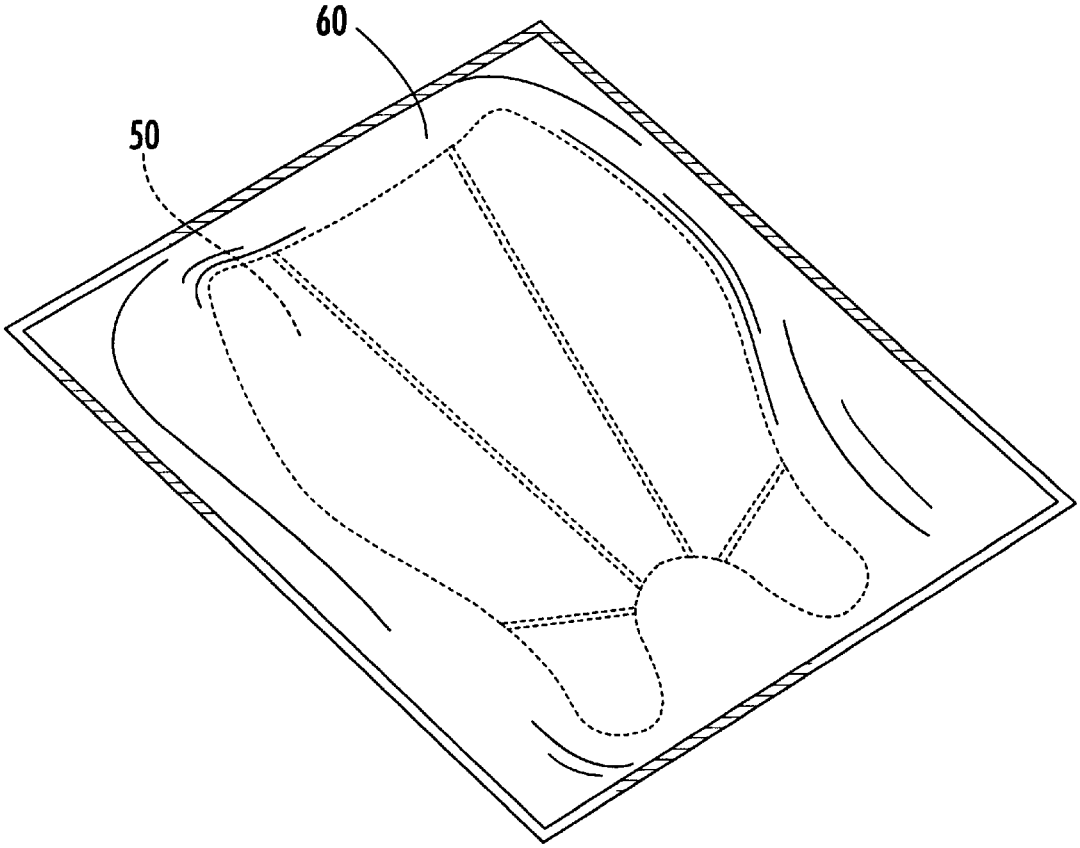
FIG. 5 is a perspective view of the leg guard product, including the moisture-proof packaging in which it is stored until application to the leg.

As is shown in FIG. 5, the pad insert 50 is initially packaged in an outer moisture-impervious laminated foil pouch 60 in which the pad insert 50 is sealed in the absence of moisture. The preferred structure of the outer moisture-impervious pouch 60 includes a 0.5 mil aluminum foil sheet sandwiched between two layers of low density polyethylene film, each layer having a thickness of 2 mils. Additionally, the pouch 60 can include an outer layer of laminated 60 gauge bi-axially oriented nylon film. This laminate structure, when properly formed into an envelope and sealed, will prevent moisture intrusion indefinitely. The pouch 60 is shown with a flexible, resin coated or impregnated pad insert

50 therein. Pad inserts 40 and 45 are also packaged in suitably-sized pouches as described above, or may be packaged together with the pad insert 50 in a single pouch for removal and application at the same time.

Figure 6:
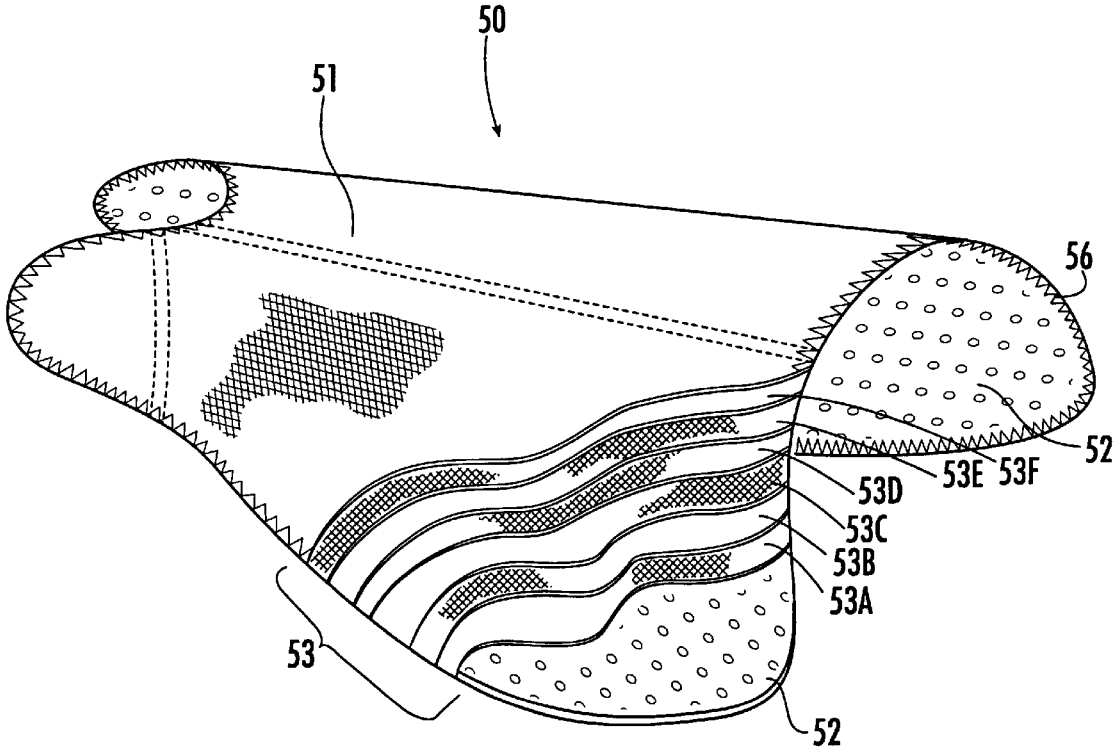
FIG. 6 is a perspective, partially exploded view of the shin pad showing the interior construction.

Referring now to FIG. 6, pad insert 50, shown in a molded configuration, comprises an overlying, open knitted fabric 51 such as a product known as Tietex, and a skin-side closed-cell EVA pad 52, which is perforated to permit water to easily reach the substrate during molding and to permit air and moisture flow from the body of the wearer during use. A moisture-curable substrate 53 formed of six layers of knitted or woven fiberglass fabric 53A–F impregnated with a moisture-curable resin which hardens upon curing to form a rigid structure which retains shape of the body part onto which it is molded during curing. The particular embodiment illustrated in this application contains six layers of fiberglass fabric, but many other variations are equally suitable.

Other fabrics which may be suitable for the substrate 53 include fabrics made of a composition of aluminum oxide, silicone oxide and boron oxide and sold under the trademark Nextel 440 by Thermostatic Industries, Inc.; silica-based fabrics, high modulus fabrics sold under the DuPont trademark "Kevlar."

The particular suitable alternate substrate is a single thickness sheet of random laid non-continuous polyester nonwoven fabric incorporating a styrene-soluble binder filled 60 percent by volume with plastic microspheres. The product is sold under the trademark "Firet Coremate XM by Baltek. This product is available in 2 mm, 3 mm and 4 mm thicknesses. The 2 mm thickness has been found suitable, and weighs 2.7–3.2 oz/yd$^2$, has a cured specific gravity of 31.0–37.0 lb/ft$^3$, and a resin consumption of 3.1–3.3 oz/ft$^3$. As used in this application, the term "lightweight" and "low density" each refer to a product having values in relation to thickness within the general ranges set out above. For example, a guard made in accordance with the principles set out in this application weighs in the range of 50–100 grams.

Other Firet Coremat grades, such as Firet Coremat XX and Firet Coremat XW may also be suitable. These grades are filled with plastic microspheres to 50 percent by volume. Other products which may be suitable include a low density, nonwoven continuous strand fabric such as BaltekMat T-2000. This product has characteristics which are generally similar to Firet Coremat, but is generally unavailable in small quantities.

The fiberglass fabric layers 53A–53F are impregnated or coated with a moisture-curable resin such as polyisocyanate as described, in full U.S. Pat. No. 4,770,299. This reactive system remains stable when maintained in substantially moisture-free conditions, such as in the moisture-impervious pouch but hardens upon exposure to sufficient moisture to form a rigid, self-supporting structure. A typical formulation of the reaction system is set forth in the following table:

| Typical Formulation: | | | |
|---|---|---|---|
| Isonate↓ 143L<br>Mondur↓ CD<br>Rubinate↓ X1168 | or<br>or | polyisocyanate | 50.0% |
| Pluracol↓ P1010 | | polyol | 46.6% |
| DC-200 Silicone | | defoaming agent | 0.30% |
| Benzoyl Chloride | | stabilizer | 0.10% |

-continued

| Typical Formulation: | | |
|---|---|---|
| Thancat↓ DM-70 | catalyst | 3.0% |
| | | 100% |

A complete discussion of the parameters of the reactive system, the manner of production and the variables which apply are found in U.S. Pat. No. 4,411,262.

The polyisocyanate resin remains in a viscous, liquid unhardened state so long as the resin is not exposed to moisture. This permits the fiberglass substrate 53 and any flexible structure, such as the padding layer 52 to remain flexible and moldable so long as the resin is not exposed to moisture, and for a relatively short period of time after exposure to moisture. The curing time can be controlled to some extent by the quantity of water to which the resin is exposed. For example, exposure to water by dipping will result in quite rapid curing, while merely allowing the resin to be exposed to air will cause long curing times proportional to the amount of humidity in the air to which it is exposed.

As also shown in FIG. 6, sewing stitches 56, such as overedge seaming stitches, enclose the substrate 53 within the outer fabric layer 51 and the foam layer 52 and form a unitary structure.

Figure 7:
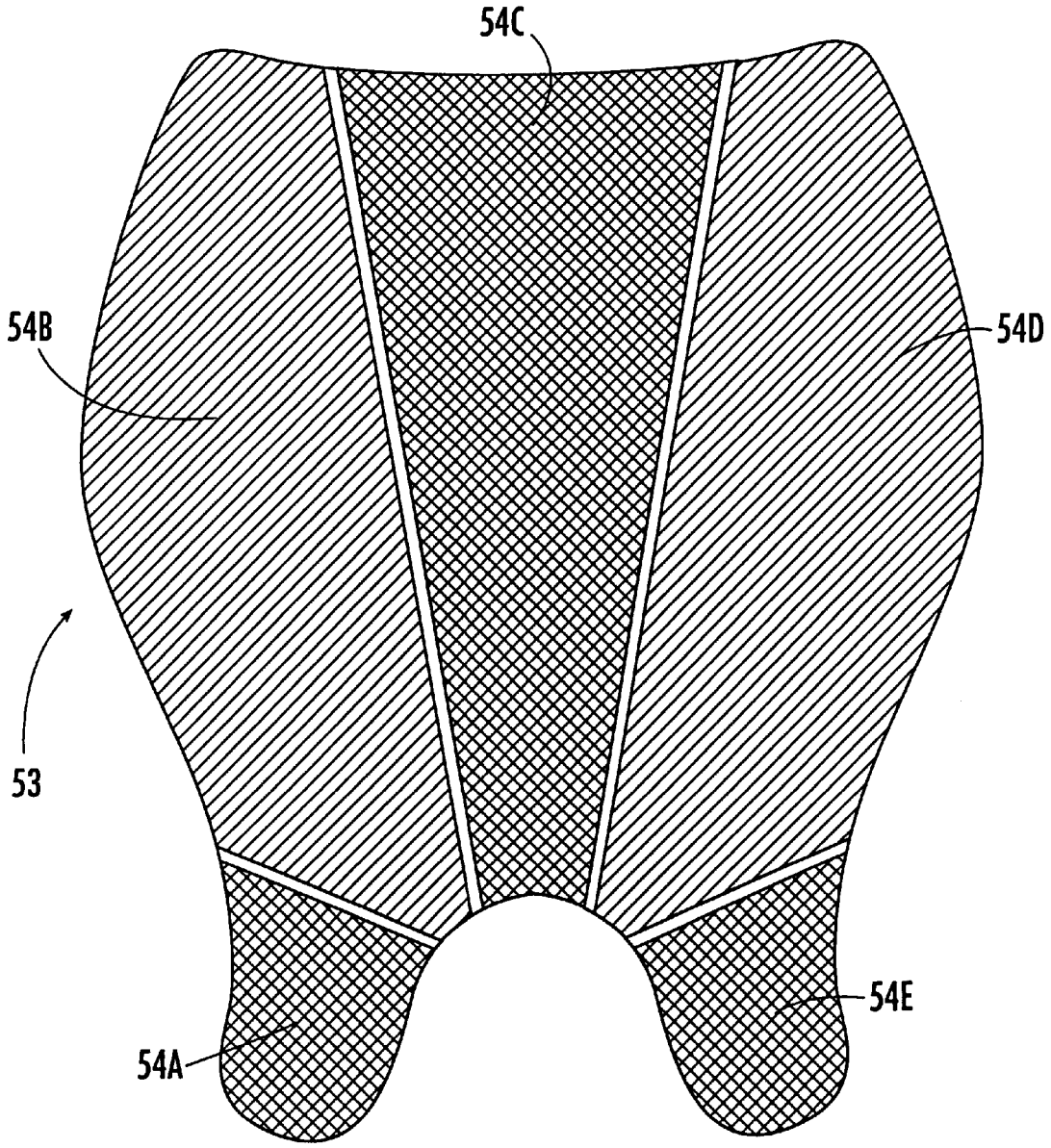
FIG. 7 is a plan view of the initially flexible protective layer of the shin pad portion of the leg guard.

The structure of the substrate 53 is more clearly shown in FIG. 7. To permit easy conformance of the relatively large pad 50 to the shin, the substrate 53 is formed of individually-shaped segments 54A–E. The lines of demarcation which form the boundaries between the separate segments 54A–E act with the fabric layer 51 and foam layer 52 as hinges to permit the pad 50 to be easily formed around the leg when being molded.

To form the catcher's leg guard 10 to a particular leg, the pad inserts 40, 45 and 50 arc removed from their respective pouches and wetted. They are immediately inserted into their respective pockets 41, 46 and 51, and the catcher's leg guard 1 0 is strapped to the leg. An additional wrapping, such as elastic bandage, may also be used to closely conform the catcher's leg guard 10 to the leg during curing. Curing generally occurs within about 10 minutes, hardening the pad inserts 40, 45 and 50 into the exact shape assumed when applied to the leg. The catcher's leg guard 10 is thus custom-formed to the particular leg and may be used solely by an individual player. The shape of the hard shell components and the pad inserts to which they are attached are not permanently changed. For this reason, a single catcher's leg guard 10 may be used by two or more players by exchanging pad inserts 40, 45 and 50 molded for one player for pad inserts 40, 45 and 50 molded to fit another player. The exchange takes place very quickly and provides an economical way of permitting enhanced safety to each of several catchers.

A custom-fitted athletic body part protector is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A body part protector for being custom-fitted to a body part, and comprising:

(a) at least two protective pad inserts, each of said pad inserts having an initially flexible protective layer comprised of a support material impregnated with a moisture-curable resin which hardens upon curing to form a rigid structure which retains a body part-defined shape into which it is molded during curing, said protective pad inserts being stored in moisture-proof conditions until use to prevent hardening prior to application of the pad inserts to the body part to be protected;

(b) a pad for enclosing the at least two protective pad inserts, said pad being conformable to the molded shape of the pad inserts;

(c) a hard shell outer protector adapted for receiving and carrying on an inner, concave surface thereof the pad and the at least two protective pad inserts positioned therein in protective position on the leg between the leg and the outer protector, said outer protector and said pad having complementary fastening elements for releasably securing the pad to the outer protector; and (d) fasteners carried by the hard shell outer protector for securing the molded and assembled body part protector to the body part to be protected.

2. A body part protector assembly according to claim 1, wherein said protective pad inserts each include a flexible inner cushion layer positioned on an inner side of the resin-impregnated layer for being placed closest to the body member.

3. A body part protector assembly according to claim 1, wherein said support material comprises a plurality of overlaid thicknesses of fiberglass.

4. A body part protector assembly according to claim 3, wherein said plurality of thicknesses of fiberglass comprises at least five thicknesses and no more than seven thicknesses.

5. A body part protector assembly according to claim 1, wherein said pad comprises an envelope with compartments to hold the protective pad inserts.

6. A body part protector assembly according to claim 5, wherein said pad comprises a lightweight fabric.

7. A body part protector assembly according to claim 1, wherein said complementary fastening elements comprise fastener straps carried by said pad having complementary touch fastener elements thereon and slots formed in said hard shell outer protector adjacent side edges thereof for receiving said fastener straps therethrough, each of said fastener straps adapted for being folded over itself and secured into a loop with a segment of the hard shell outer protector between a respective slot and adjacent side edge positioned therein.

8. A baseball catcher's leg guard for being custom-fitted to the leg of a baseball catcher, and comprising:

(a) a shin pad and a knee pad, said shin pad and said knee pad each having an initially flexible protective layer comprised of a support material impregnated with a moisture-curable resin which hardens upon curing to form a rigid structure which retains the shape of the shin and knee, respectively, onto which they are molded during curing, said shin and knee pad inserts being stored in moisture-proof conditions until use to prevent hardening prior to application of the pad inserts to shin and knee, respectively;

(b) a pad for enclosing the shin pad and knee pad, said pad being conformable to the molded shape of the pad inserts;

(c) a hard shell shin protector for extending along the anterior aspect of the lower leg in protective relation to the shin bone and adapted for receiving and carrying the pad and the shin pad positioned therein on an inner, concave surface thereof between the shin protector and the leg, said shin protector and said pad having complementary fastening elements for releasably securing the pad to the shin protector;

(d) a hard shell knee protector attached to and positioned in vertical alignment with the shin protector in overlying protective relation to the knee and adapted for receiving and carrying the pad and the knee pad positioned therein on an inner, concave surface thereof between the knee protector and the leg, said knee protector and said pad having complementary fastening elements for releasably securing the pad to the knee protector; and (d) fasteners carried by the hard shell shin protector and hard shell knee protector for securing the molded and assembled shin guard to the leg.

9. A catcher's leg guard according to claim 8, and including at least one foot protector flexibly attached to a lower end of the hard shell shin protector for overlying and protecting the foot.

10. A catcher's leg guard according to claim 8, and including first and second foot protectors flexibly attached end-to-end along a longitudinal axis of the shin guard to a lower end of the hard shell shin protector for overlying and protecting the foot.

11. A catcher's leg guard according to claim 8, wherein said knee pad is comprised of first and second knee pad segments, said first segment positioned to overlie and protect the lower knee and uppermost portion of the tibia bone and the second segment positioned to overlie and protect the patella of the knee and the lowermost portion of the femur.

12. A method of constructing a body part protector assembly for being custom-fitted to a body part to be protected, and comprising the steps of:

(a) providing at least two protective pad inserts, each of said pad inserts having an initially flexible protective layer comprised of a support material impregnated with a moisture-curable resin which hardens upon curing to form a rigid structure which retains a body part-defined shape into which it is molded during curing, said protective pad inserts being stored in moisture-proof conditions until use to prevent hardening prior to application of the pad inserts to the body part to be protected;

(b) providing a pad for enclosing the at least two protective pad inserts, said pad being conformable to the molded shape of the pad inserts;

(c) providing a hard shell outer protector adapted for receiving and carrying on an inner, concave surface thereof the pad and the at least two protective pad inserts positioned therein in protective position on the leg between the leg and the outer protector, said outer protector and said pad having complementary fastening elements for releasably securing the pad to the outer protector;

(d) providing fasteners carried by the hard shell outer protector for securing the molded and assembled body part protector to the body part to be protected;

(e) removing the protective pad inserts from the moisture-proof condition;

(f) exposing the protective pad inserts to moisture;

(g) molding the protective pad inserts to the body part to be protected;

(h) maintaining the position of the protective pad inserts until the protective pad inserts have hardened; and (i) fastening the pad with the protective pad inserts therein to the hard shell outer protector to form the completed body part protector assembly.

13. A method according to claim 12, wherein said protective pad inserts are inserted into the pad before the pad inserts are molded onto the body part.

14. A method according to claim 12, wherein said protective pad inserts are inserted after the pads inserts have been molded onto the body part and hardened.

15. A method according to claim 12, wherein said body part protector assembly comprises a baseball catcher's leg guard.

16. A baseball catcher's leg guard for being custom-fitted to the leg of a baseball catcher, and comprising:

(a) a shin pad and a knee pad, said shin pad and said knee pad each having an initially flexible protective layer comprised of a support material impregnated with a moisture-curable resin which hardens upon curing to form a rigid structure which retains the shape of the shin and knee, respectively, onto which they are molded during curing, said shin and knee pad inserts being stored in moisture-proof conditions until use to prevent hardening prior to application of the pad inserts to shin and knee, respectively;

(b) a hard shell shin protector for extending along the anterior aspect of the lower leg in protective relation to the shin bone and adapted for receiving and carrying the shin pad on an inner, concave surface thereof between the shin protector and the leg, said shin protector having complementary fastening elements for releasably securing the shin pad to the shin protector;

(d) a hard shell knee protector attached to and positioned in vertical alignment with the shin protector in overlying protective relation to the knee and adapted for receiving and carrying the knee pad positioned therein on an inner, concave surface thereof between the knee protector and the leg, said knee protector and said knee pad having complementary fastening elements for releasably securing the knee pad to the knee protector; and (d) fasteners carried by the hard shell shin protector and hard shell knee protector for securing the molded and assembled shin guard to the leg.

17. A catcher's leg guard according to claim 16, and including at least one foot protector flexibly attached to a lower end of the hard shell shin protector for overlying and protecting the foot.

18. A catcher's leg guard according to claim 16, and including first and second foot protectors flexibly attached end-to-end along a longitudinal axis of the shin guard to a lower end of the hard shell shin protector for overlying and protecting the foot.

19. A catcher's leg guard according to claim 16, wherein said knee pad is comprised of first and second knee pad segments, said first segment positioned to overlie and protect the lower knee and uppermost portion of the tibia bone and the second segment positioned to overlie and protect the patella of the knee and the lowermost portion of the femur.

* * * * *